US005381724A

United States Patent [19]

Kawahara et al.

[11] Patent Number: 5,381,724

[45] Date of Patent: Jan. 17, 1995

[54] SWASH-PLATE, PLUNGER-TYPE HYDRAUL PRESSURE APPARATUS

[75] Inventors: Eiichiro Kawahara, Tokorozawa; Takashi Nakamura, Utsunomiya; Mitsumasa Furumoto, Utsunomiya; Kazuaki Sakai, Utsunomiya, all of Japan

[73] Assignee: Honda Giken Kogyo Kabushiki Kaisha, Tokyo, Japan

[21] Appl. No.: 52,819

[22] Filed: May 12, 1993

Related U.S. Application Data

[63] Continuation of Ser. No. 827,054, Jan. 28, 1992, abandoned.

[30] Foreign Application Priority Data

Jan. 28, 1991 [JP] Japan ..... 3-026939

[51] Int. Cl.[6] ..... F01B 3/00; F01B 13/04

[52] U.S. Cl. ..... 92/12.2; 92/57; 92/71; 91/500; 417/218

[58] Field of Search ..... 92/12.2, 71, 57; 91/499, 500, 504, 505; 417/218, 269

[56] References Cited

U.S. PATENT DOCUMENTS

| | | | |
|---|---|---|---|
| 1,210,649 | 1/1913 | Jennings | 417/269 |
| 2,040,390 | 5/1936 | Loe | 92/71 |
| 2,133,270 | 10/1938 | Blum | 92/71 |
| 4,492,527 | 1/1985 | Swain et al. | 92/12.2 |
| 4,516,475 | 5/1985 | Fricke | 92/57 |
| 5,046,403 | 9/1991 | Riedhammer | 92/71 |

FOREIGN PATENT DOCUMENTS 2102958 4/1990 Japan .

*Primary Examiner*—Edward K. Look
*Assistant Examiner*—Hoang Nguyen
*Attorney, Agent, or Firm*—Lyon & Lyon

[57] ABSTRACT

A swash-plate, plunger-type hydraulic pressure apparatus, which may operate as a hydraulic pump or motor, includes a cylinder block, an annular array of plungers slidably held in the cylinder block, a swash plate, a plurality of shoes angularly movably coupled respectively to the ends of the plungers, and a retainer plate mounted adjacent the swash plate and holding the shoes in slidable contact with the sliding surface. The shoes have respective annular grooves defined in the outer cylindrical surfaces thereof. The retainer plate has a plurality of shoe holding holes defined therein and a like plurality of cutout openings extending from the holes. The shoe holding holes communicate with one of outer and inner circumferential edges of the retainer plate through the cutout openings, respectively. The cutout openings have a width slightly larger than the outside diameter of the annular grooves, whereby the annular grooves can be inserted into the shoe holding holes, respectively, through the cutout openings.

5 Claims, 10 Drawing Sheets

SWASH-PLATE, PLUNGER-TYPE HYDRAUL PRESSURE APPARATUS

This application is a continuation application of application Ser. No. 07/827,054, filed on Jan. 28, 1992 now abandoned.

BACKGROUND OF THE INVENTION

1. Field of the Invention

The present invention relates to a swash-plate, plunger-type hydraulic pressure apparatus such as a swash-plate, plunger-type hydraulic pump or motor, and more particularly to an attachment structure for a retainer plate which prevents shoes from being lifted off a swash plate during operation of such a swash-plate, plunger-type hydraulic pressure apparatus.

2. Description of the Prior Art

One conventional swash-plate, plunger-type hydraulic pressure apparatus is shown in FIG. 14 of the accompanying drawings. As shown in FIG. 14, the prior swash-plate, plunger-type hydraulic pressure apparatus includes a cylinder block 1 having an annular array of cylinder bores 1*a* surrounding an axis C1. A plurality of plungers 7 are slidably fitted in the respective cylinder bores 1*a*. The plungers 7 have spherical ends 7*a* to which respective shoes 2 are swingably coupled. The shoes 2 are slidably held against a sliding surface 8*a* of a swash plate 8. When the cylinder block 1 rotates about the axis C1, the shoes 2 slide on the swash plate 8 and the plungers 7 reciprocally move in the respective cylinder bores 1*a*. In order to prevent the shoes 2 from being lifted off the sliding surface 8*a*, the shoes 2 are held against the sliding surface 8*a* by a retainer plate 3. The retainer plate 3 is held in position by a holder plate 5 that is fastened to the swash plate 8 by bolts 6.

The swash-plate, plunger-type hydraulic pressure apparatus of the above structure is disclosed in Japanese Laid-Open Patent Publication No. 2-102958, for example.

The reasons why the shoes 2 are held against the sliding surface 8*a* by the retainer plate 3 will be described below in specific details.

The plungers which operate in a pumping action switch from a discharge stroke to a suction stroke at their top dead center in the cylinder bores. Since the direction of movement of the plungers in the discharge stroke is opposite to the direction of movement of the plungers in the suction stroke, it is necessary that forces strong enough to overcome the inertia of the plungers in the discharge stroke be applied to the plungers at their top dead center so as to start the suction stroke.

During the pumping action, the plungers draw oil because of their own movement in the suction stroke. It is necessary to impose forces on the plungers to enable the plungers to make their own movement to draw oil.

In the case where the swash-plate, plunger-type hydraulic pressure apparatus is of the variable displacement type, the inclination of the swash plate is varied to change the displacement. When the inclination of the swash plate is varied, the shoes would be spaced from the swash plate unless the shoes were moved in a manner to catch up the variation in the inclination of the swash plate. For example, if the angle of inclination of the swash plate is varied while the plungers are in a lower-pressure stroke, the shoes would be lifted off the swash plate. When the plungers are then shifted into a higher-pressure stroke, the plungers would be pushed by the high pressure in the cylinder bores, forcing the shoes to hit the swash plate, producing noise and reducing durability.

As shown in FIG. 15 of the accompanying drawings, if the center G1 of gravity of each shoe 2 is spaced from the center O1 about which the shoe 2 is swingable with respect to the plunger 7, then the centrifugal force F1 which is applied to the shoe 2 as the cylinder block 1 rotates acts as a force tending to turn the shoe 2 about the center O1. Therefore, the shoe 2 is liable to be tilted with respect to the sliding surface 8*a*, and its lower surface tends to be spaced from the sliding surface 8*a*. The lower surface of the shoe 2 has a groove 2*a* defined therein which serves as a hydrostatic pressure bearing. The groove 2*a* is supplied with hydraulic pressure from the cylinder bore 1a through an oil passage (not shown) defined through the plunger 7 and an oil passage defined through the shoe 2. If the shoe 2 were lifted off the sliding surface 8*a*, as described above, the oil would leak out of the groove 2*a*, and the performance of the static pressure bearing would be lowered.

The retainer plate 3 is employed to meet the above requirements and to avoid the above drawbacks. To hold the shoes 2 against the sliding surface 8*a* with the retainer plate 3, the retainer plate 3 is required to be positioned in place. In FIG. 14, the retainer plate 3 is held by the holder plate 5 through a bearing 4 interposed therebetween. The retainer plate 3 may instead be held directly by the holder plate 5 without any bearing therebetween. Alternatively, an inner circumferential side of the retainer plate 3 may be pressed by a spherical ring or the like.

With the shoes 2 held against the sliding surface 8*a* by the retainer plate 3, as described above, the retainer plate 3 is kept in contact with the other member, such as the bearing, the holder plate, or the spherical ring, than the shoes 2. The retainer plate 3 is therefore subject to a rolling resistance or sliding resistance imposed by one of these other members. In addition, the number of components used is increased by the other member that is required to position the retainer plate 3.

During the pumping action of the swash-plate, plunger-type hydraulic pressure apparatus, only those shoes which are associated with plungers that operate in the suction stroke are actually required to be held against the swash plate. Those plungers that operate in the discharge stroke are pressed against the swash plate under forces produced in reaction to the discharge pressure of the plunger. If the retainer plate is attached in engagement with all the shoes, then the retainer plate can be positioned under pressing forces that act on those plungers which are in the discharge stroke. As a result, any one of the above other members for positioning the retainer plate may be dispensed with.

Japanese Laid-Open Patent Publication No. 2-102958 discloses an apparatus having an annular disk plate disposed between a swash plate and shoes, and a retainer plate positioned upwardly of the shoes, the disk plate and the retainer plate being fastened to each other by bolts with the shoes clamped between the disk plate and the retainer plate. With this arrangement, the pressing forces acting on those plungers that are in the discharge stroke are applied to hold the bolted plates on the swash plate, thus positioning the shoes that are clamped between the disk plate and the retainer plate. Consequently, no special member is required for positioning the retainer plate, and the above problem of rolling or sliding resistance is eliminated.

The disclosed apparatus is, however, disadvantageous in that the disk plate is of a special shape, cannot easily be manufactured, and is highly expensive to manufacture. Therefore, the cost of the apparatus is relatively high, the number of components of the apparatus is large and so is the weight of the apparatus.

FIG. 18(A) of the accompanying drawings shows a conventional shoe composed of members *9a*, *9b* that are threadedly fastened to each other with a retainer plate 3 clamped between the members *9a*, *9b*. The shoe is thus held on the retainer plate 3.

FIG. 16(B) of the accompanying drawings illustrates a conventional shoe comprising members *9c*, *9d* that are welded to each other with a retainer plate 3 clamped between the members *9a*, *9b*. The shoe is also held on the retainer plate 3.

In the structures shown in FIGS. 16(A) and 16(B), however, the members *9a*, *9b* and *9c*, *9d* are required to have a relatively large thickness where they are threaded or welded so that their joined regions have a high mechanical strength. As a consequence, the shoes are necessarily large in size, and the entire apparatus is also large in size and made up of a large number of components.

SUMMARY OF THE INVENTION

In view of the aforesaid problems of the conventional swash-plate, plunger-type hydraulic pressure apparatus, it is an object of the present invention to provide a swash-plate, plunger-type hydraulic pressure apparatus which has shoes of unitary integral structure that are reliably held in engagement with a retainer plate, and that are positioned and retained under a hydraulic pressure applied from plungers that are in a discharge stroke.

To achieve the above object, there is provided in accordance with the present invention a swash-plate, plunger-type hydraulic pressure apparatus comprising a cylinder block rotatable about an axis, an annular array of plungers slidably held in the cylinder block in surrounding relationship to the axis, a swash plate having a sliding surface confronting ends of the plungers, a plurality of shoes confronting the sliding surface and angularly movably coupled respectively to the ends of the plungers, and a retainer plate mounted on the swash plate and holding the shoes in slidable contact with the sliding surface, the shoes having respective necks as annular grooves defined in outer circumferential surfaces thereof, the retainer plate having a plurality of shoe holding holes defined therein and a plurality of recesses or cutout openings defined therein, the shoe holding holes communicating with one of outer and inner circumferential edges of the retainer plate through the recesses cutout openings, respectively, the recesses cutout openings having a width slightly larger than the outside diameter of the necks or annular grooves, whereby the annular grooves can be inserted into the shoe holding holes, respectively, through the recesses cutout openings.

The shoe holding holes have an inside diameter large enough to allow the shoes, with the annular grooves inserted in the respective shoe holding holes, to make an elliptical movement on the swash plate in response to rotation of the cylinder block, each of the shoes having portions on the opposite sides of the annular grooves, the portions having an outside diameter larger than the inside diameter of the shoe holding holes.

Each of the cutout openings is connected to one of the shoe holding holes in a position other than a region where the annular grooves engages an inner circumferential surface of the shoe holding hole during the elliptical movement of the shoe on the swash plate in response to rotation of the cylinder block.

Each of the shoes has a center of gravity substantially aligned with the center of angular movement of the shoe with respect to the plunger.

The annular grooves of the shoes can be inserted into the shoe holding holes through the cutout openings in the retainer plate. Therefore, even if the shoes with the annular grooves are of a machined unitary integral structure, they can be installed on the retainer plate and held in place thereon. With the shoes thus retained on the retainer plate, when the hydraulic pressure apparatus operates as a pump, the retainer plate is positioned and held in place by pressing forces acting on those plungers which are in a discharge stroke. The retainer plate thus held in place is effective to hold the shoes connected to those plungers which are in a suction stroke.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
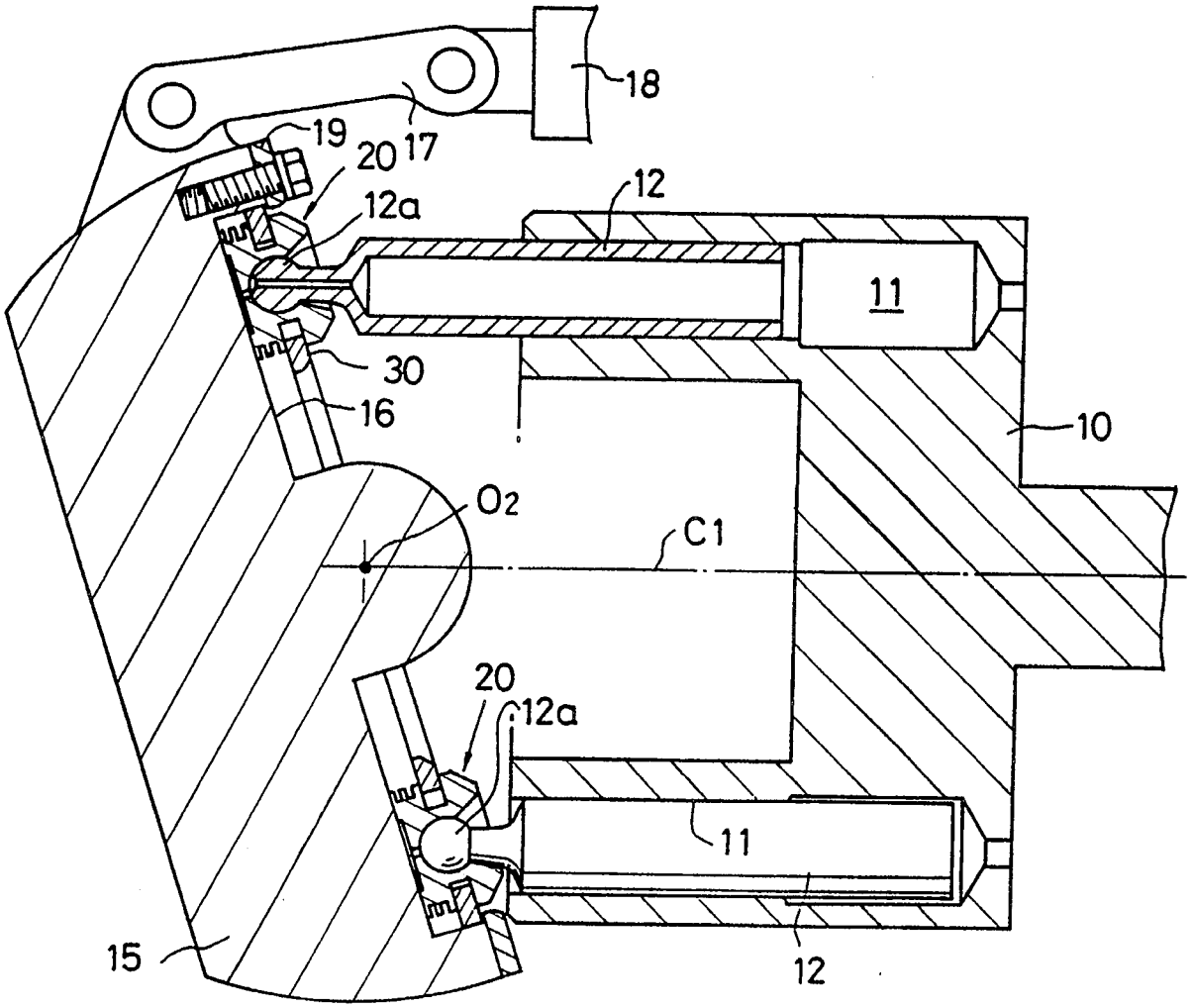
FIG. 1 is a cross-sectional view of a swash-plate, plunger-type hydraulic pump according to the present invention.

FIG. 1 shows a swash-plate, plunger-type hydraulic pump according to the present invention. The swash-plate, plunger-type hydraulic pump comprises a cylinder block 10 rotatable about an axis C1 and having an annular array of axially extending cylinder bores 11 spaced at equal circumferential intervals in surrounding relationship to the axis C1. A plurality of plungers 12 are slidably fitted in the respective cylinder bores 11. The plungers 12 have spherical ends 12*a* to which respective shoes 20 are swingably coupled. The shoes 20 are slidably held against a sliding surface 16 of a swash plate 15. When the cylinder block 10 rotates about the axis C1, the shoes 20 slide on the swash plate 15 and the plungers 12 reciprocally move in the respective cylinder bores 11. In order to prevent the shoes 20 from being lifted off the sliding surface 16 of the swash plate 15, the shoes 20 are held against the sliding surface 16 by a retainer plate 30.

A holder plate 19 is fastened by bolts to the swash plate 15 radially outwardly of the retainer plate 30. The holder plate 19 serves to prevent the retainer plate 30 from being dislodged from the swash plate 15. Normally, the holder plate 19 and the retainer plate 30 are spaced from each other.

The swash plate 15 is angularly movable about an axis O2 that extends perpendicularly to the axis C1, i.e., the sheet of FIG. 1. The angle by which the swash plate 15 is inclined with respect to the cylinder block 10 is adjusted when the swash plate 15 is angularly moved about the axis O2. The swash plate 15 is operatively coupled through a joint member 17 to a servocylinder 18 which, when operated, causes the swash plate 15 to be turned about the axis O2.

Figure 2:
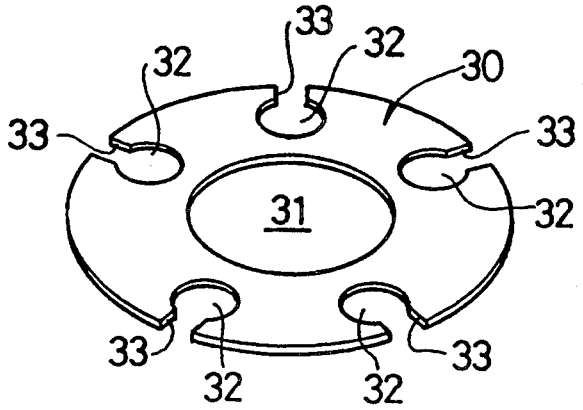
FIG. 2 is a perspective view of a retainer plate in the swash-plate, plunger-type hydraulic pump shown in FIG. 1.

As shown in FIG. 2, the retainer plate 30 is in the form of an annular plate with a central circular hole 31. The illustrated hydraulic pump has five plungers 11. The retainer plate 30 has five shoe holding holes 32 defined therein and spaced at equal circumferential intervals, and five cut openings 33 of predetermined width defined therein radially outwardly of the respective shoe holding holes 32. The shoe holding holes 32 communicate with the outer circumferential edge of the retainer plate 30 through the respective cutout openings 33.

Figure 3:
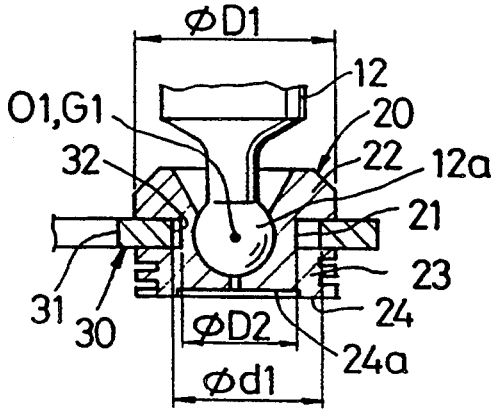
FIG. 3 is a fragmentary cross-sectional view of a shoe and the retainer plate which are coupled to each other in the the swash-plate, plunger-type hydraulic pump shown in FIG. 1.

As shown in FIG. 3, each of the shoes 20 has a cylindrical shape with a lower surface 24 thereof held in slidable contact with the sliding surface 18 of the swash plate 15. The lower surface 24 has a groove 24*a* serving as a hydrostatic pressure bearing. The shoe 20 also has an annular groove 21 positioned substantially centrally in and along the outer peripheral or circumferential surface of the cylindrical body portion of the shoe. The edge of the shoe holding hole 32 in the retainer plate 30 engages in the annular groove 21, thereby holding the shoe 20 on the retainer plate 30. The shoe holding hole 32 has an inside diameter d1 smaller than the outside diameter D1 of upper and lower portions 22, 23 of the shoe 20 which are positioned above and below the annular groove 21. The shoe 20 is retained on the retainer plate 30 which is fitted between the upper and lower portions 22, 23 of the shoe 20.

Figure 4:
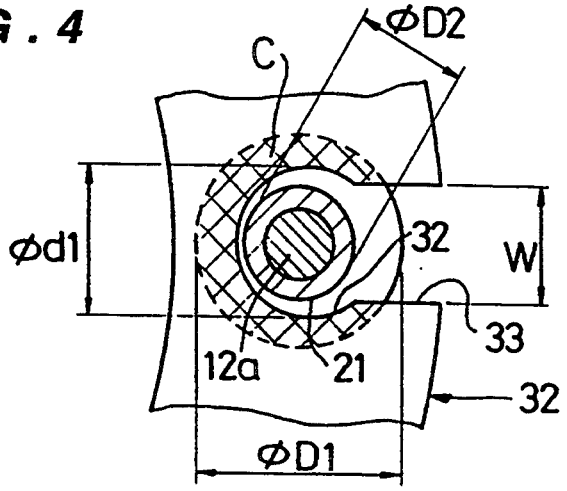
FIG. 4 is a fragmentary cross-sectional view of the shoe and the retainer plate which are coupled to each other in the the swash-plate, plunger-type hydraulic pump shown in FIG. 1.

The shoe 20 is machined such that the annular groove 21 is cut in a unitary cylindrical blank. Therefore, if the retainer plate 30 were formed with the shoe holding holes 32 only, the edges of the shoe holding holes 32 could not be inserted into the respective annular grooves 21 of the shoes 20. According to the present invention, the cutout openings 33 defined in the retainer plate 30 allow the annular grooves 21 of the shoes 20 to pass radially inwardly therethrough into the shoe holding holes 32. Therefore, the cutout openings 33 have a width W (FIG. 4) slightly larger than the outside diameter D2 of the annular grooves 21 (the diameter of the bottom of the annular groove 21).

To install the shoes 20 on the retainer plate 30, the annular grooves 21 of the shoes 20 are guided through the respective cutout openings 33 into the corresponding shoe holding holes 32. As installed, the retainer plate 30 is fitted between the upper and lower portions 22, 23 of each shoe 20 in a region C that is shown cross-hatched in FIG. 4.

The inside diameter d1 of each shoe holding hole 32 is selected to allow the shoe 20 to move on the swash plate 15 in response to rotation of the cylinder block 10 about the axis C1. The movement of the shoe 20 on the swash plate 15 will be described in detail below.

Figure 5:
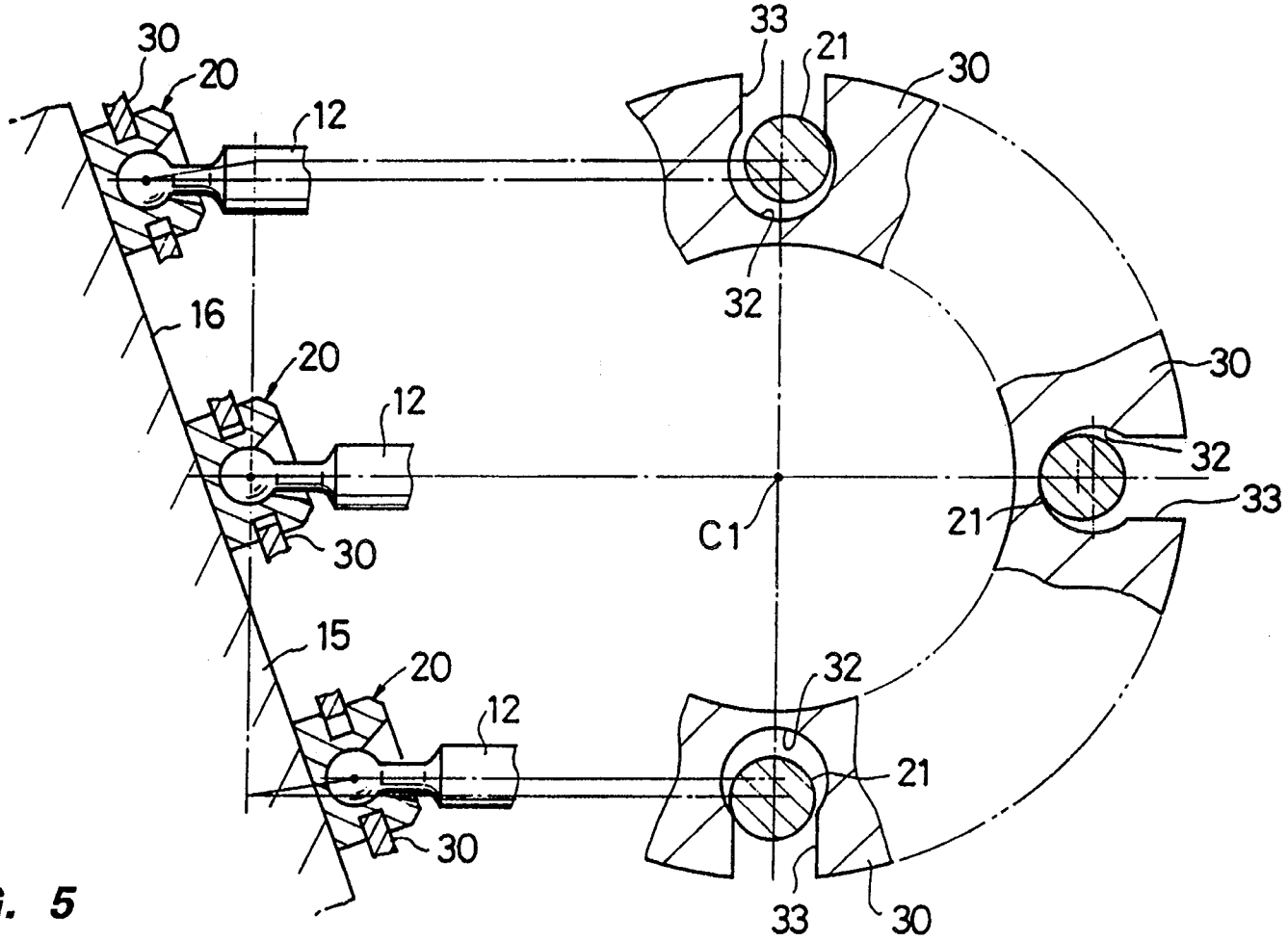
FIG. 5 is a fragmentary cross-sectional view showing the manner in which a shoe moves on a swash plate in the the swash-plate, plunger-type hydraulic pump shown in FIG. 1.

The retainer plate 30 rotates with the shoes 20 on the sliding surface 16 of the swash plate 15. The plungers 12 to which the respective shoes 20 are coupled rotate with the cylinder block 10 around the axis C1. Since the plungers 20 rotate through a circular path, the shoes 20 make an elliptical movement on the swash plate 15. The elliptical movement of each shoe 20 is illustrated in FIG. 5. In order to allow the retainer plate 30 to rotate over the swash plate 15 while permitting such an elliptical movement of the shoes 20, the inside diameter d1 of the shoe holding holes 32 is greater than the outside diameter D2 of the annular grooves 21 of the shoes 20. FIG. 5 shows the positional relationship between the annular groove 21 and the associated shoe holding hole 32 at angular intervals of 90° while the shoe 20 is making an angular movement through 180°. The inside diameter d1 of the shoe holding hole 32 is dimensioned to allow the elliptical movement of the shoe 20.

Each of the shoes 20 has a center G1 of gravity (see FIG. 3) which is substantially aligned with the center O1 (i.e., the center of the spherical end 12*a*) of angular movement of the shoe 20 with respect to the plunger 12. With the center G1 of gravity thus positioned, when the shoe 20 is subjected to centrifugal forces upon rotation of the cylinder block 20, the centrifugal forces act toward the center O1 of angular movement of the shoe 20. The centrifugal forces do not act as forces tending to swing the shoe 20.

The annular groove 21 is defined centrally in the outer cylindrical surface of the shoe 20, and the upper and lower portions 22, 23 of the shoe 20 are of substantially the same shape as each other. Therefore, it is easy to bring the center G1 of gravity into alignment with the center O1 of angular movement of the shoe 20.

Figure 6:
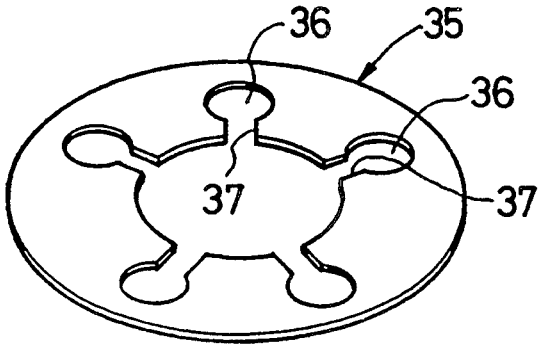
FIG. 6 is a perspective view of a different retainer plate.

In the above embodiment, the shoe holding holes 32 and the outer circumferential edge of the retainer plate 30 communicate with each other through the respective cutout openings 33, and the shoes 20 are inserted radially inwardly into the retainer plate 30. FIG. 6 shows another retainer plate 35 which has shoe holding holes 36 defined therein and communicating with the inner circumferential edge of the retainer plate 35 through respective cutout openings 37 defined radially inwardly of the respective shoe holding holes 36. The shoes 20 are inserted radially outwardly into the retainer plate 35. However, the cut openings 33 shown in FIG. 2 which provide communication between the shoe holding holes 32 and the outer circumferential edge of the retainer plate 30 are effective to make the mass of rotational inertia of the retainer plate smaller.

Figure 7:
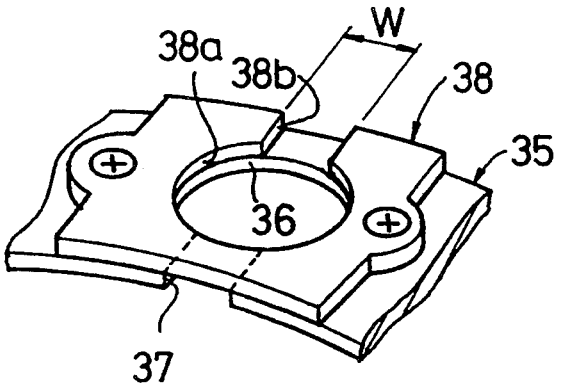
FIG. 7 is a fragmentary perspective view of another different retainer plate.
Figure 8:
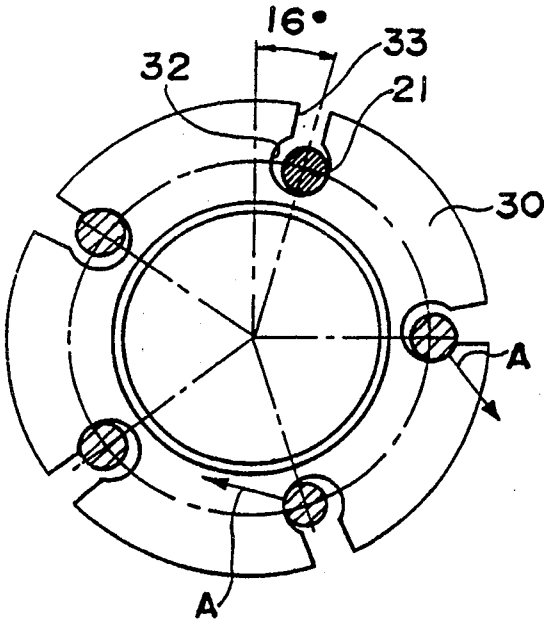
FIGS. 8(A) through 8(C) are cross-sectional views showing the shoes and the retainer plate in the swash-plate, plunger-type hydraulic pump shown in FIG. 1.
Figure 8:
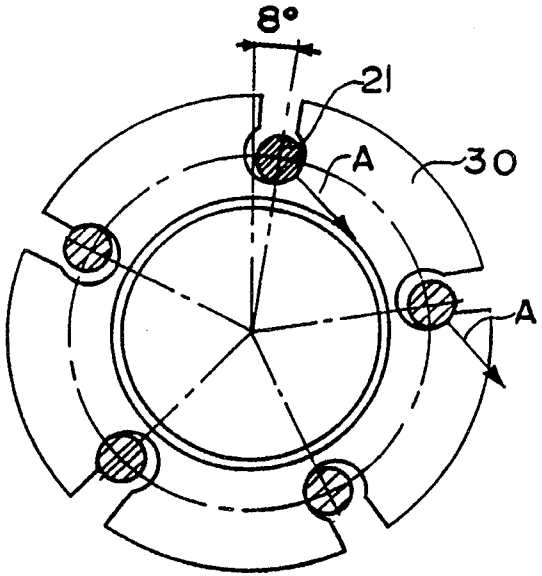
Figure 8:
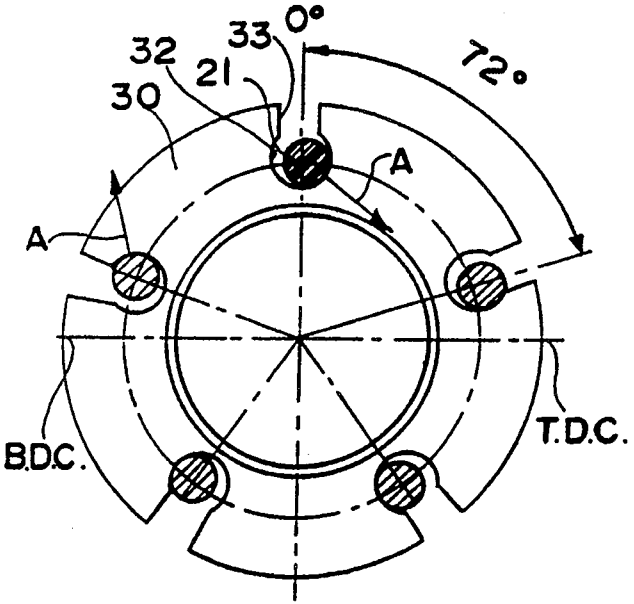
Figure 9:
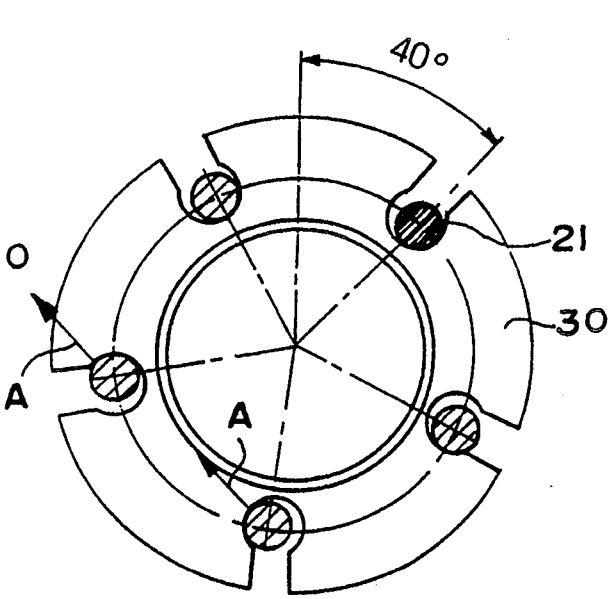
FIGS. 9(D) through 9(F) are cross-sectional views showing the shoes and the retainer plate in the swash-plate, plunger-type hydraulic pump shown in FIG. 1.
Figure 9:
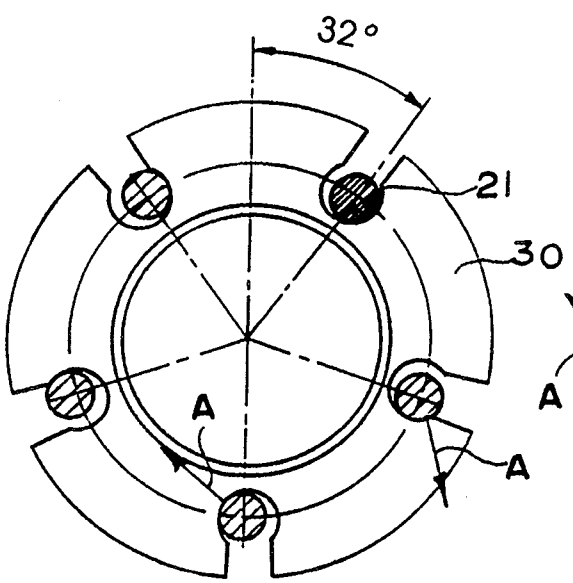
Figure 9:
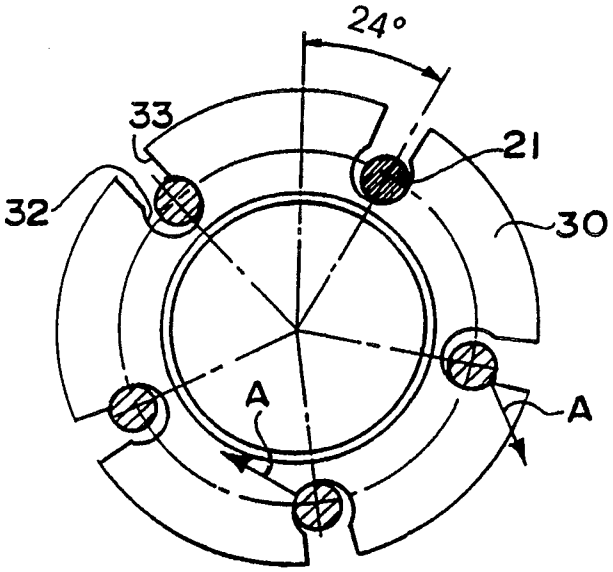
Figure 10:
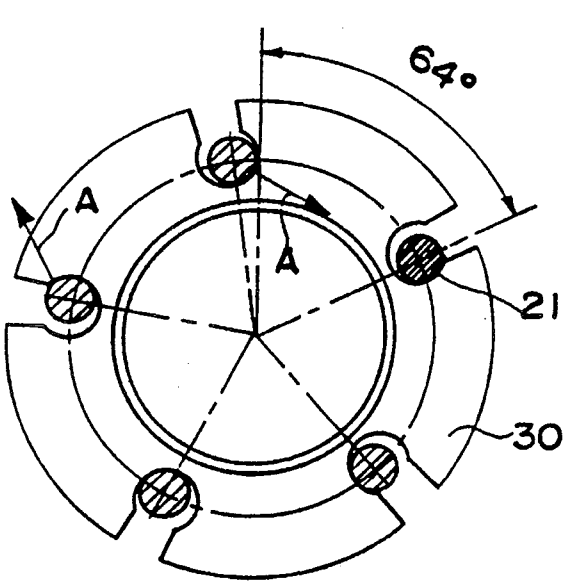
FIGS. 10(G) through 10(I) are cross-sectional views showing the shoes and the retainer plate in the swash-plate, plunger-type hydraulic pump shown in FIG. 1.
Figure 10:
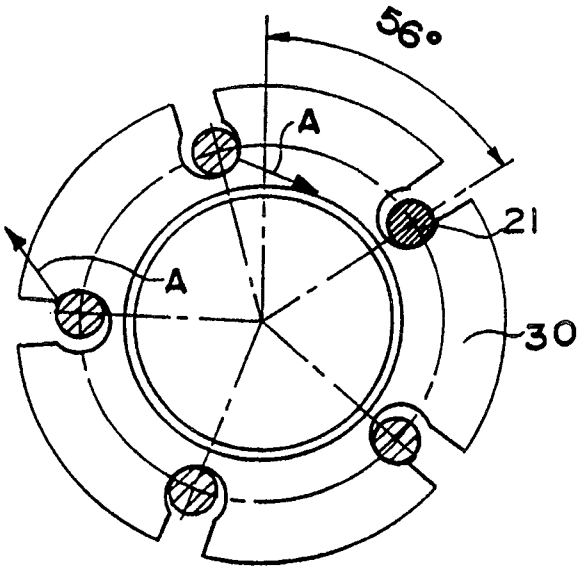
Figure 10:
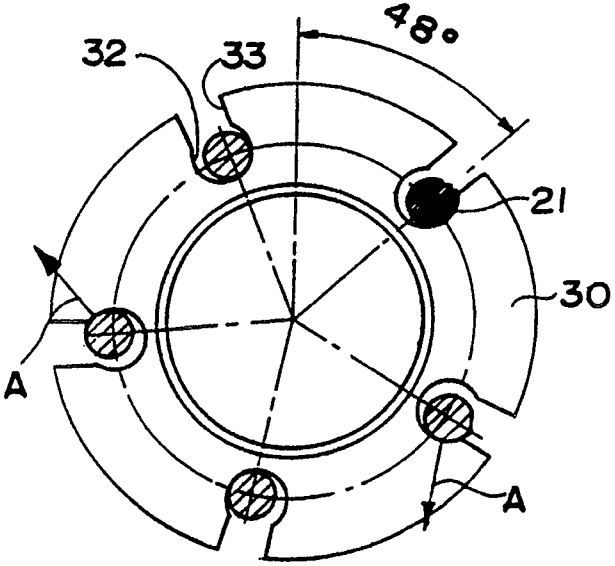

To reliably prevent the shoes 20 from being dislodged out of the cutout openings 37 (or 33), a keeper plate 38 may be fastened to the retainer plate 35 (or 30) at each of the shoe holding holes 38 (or 32), as shown in FIG. 7. The keeper plate 38 has a second shoe holding hole **38*a* having the same diameter d1 as the shoe holding hole 38 (or 32) and a second cutout opening 38*b* having the same width W as the cutout opening 37 (or 33) but opening in a direction opposite to the cutout opening 37 (or 33). Therefore, the keeper plate 38 closes the cutout openings 37 (or 33) defined in the retainer plate 35 (or 30**).

When the cylinder block 10 of the hydraulic pump rotates about the axis C1, the plungers 12 rotate therewith around the axis C1, and the retainer plate 30 also rotates by being pushed by the shoes 20. More specifically, during rotation of the cylinder block 10, the shoes 20 slide on the swash plate 15 while the outer circumferential surface of the annular groove 21 of each shoe 20 is engaging the inner circumferential surface or edge of the shoe holding hole 32. The retainer plate 30 is therefore pushed by the shoes 20 and rotates over the swash plate 15 because of the engagement between the annular grooves 21 and the edges of the shoe holding holes 32.

The region where the outer circumferential surface of the annular groove 21 of each shoe 20 engages the inner circumferential surface or edge of the shoe holding hole 32 varies as the cylinder block 10 rotates, as described below with reference to FIGS. 8(A)–8(C), 9(D)–9(F), and 10(G)–10(I).

FIGS. 8(A)–8(C), 9(D)–9(F), and 10(G)–10(I) show the manner in which the annular groove 2l of each shoe 20 and the edge of the shoe holding hole 32 engage each other at angular increments of 8° when the cylinder block 10 with the five plungers 12 rotates. Each plunger 12 reaches the top dead center (T.D.C.) of its stroke in the cylinder bore when the plunger 12 is in the right-hand angular position indicated by T.D.C. (see FIG. 8(A), and also reaches the bottom dead center (B.D.C.) of its stroke in the cylinder bore when the plunger 12 is in the lefthand angular position indicated by B.D.C. The shoes 20 are rotated clockwise through angular intervals of 8° from the position shown in FIG. 8(A) to the position shown in FIG. 10(I). In each of FIGS. 8(A)–8(C), 9(D)–9(F), and 10(G)–10(I), the annular groove 21 and the edge of the shoe holding hole 32 engage each other at the end of an arrow A, which points to the direction in which reactive forces are applied to the retainer plate 30. It can be seen from FIGS. 8(A)–8(C), 9(D)–9(F), and 10(G)–10(I) that the region where the annular groove 21 of each shoe 20 and the edge of the shoe holding hole 32 engage each other varies as the cylinder block 10 rotates.

Figure 11:
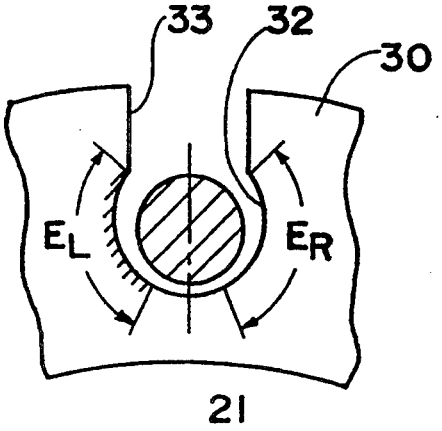
FIG. 11 is a fragmentary cross-sectional view of the shapes of a shoe holding hole and a recess in the retainer plate, the view also showing a range in which the annular groove of a shoe can be held against an edge of the shoe holding hole.

When the cylinder block 10 makes one revolution, the annular groove 21 of each shoe 20 engages the edge or inner circumferential surface of the shoe holding hole 32 in regions indicated by ER, EL in FIG. 11. They engage each other in the region ER when the cylinder block 10 rotates clockwise as viewed in FIG. 11, and in the region EL when the cylinder block 10 rotates counterclockwise. The regions ER, EL are positioned on laterally opposite sides of the shoe holding hole 32. The cutout opening 33 is defined out of the regions ER, EL, so that the neck 21 necessarily engages the inner circumferential surface of the shoe holding hole 32.

Figure 12:
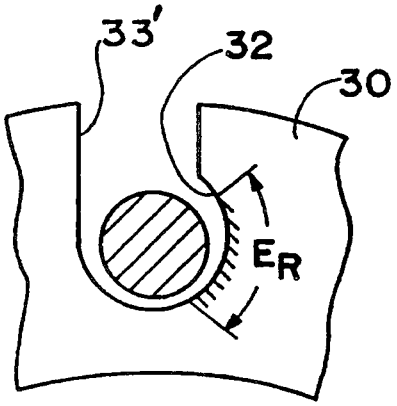
FIG. 12 is a fragmentary cross-sectional view of the shapes of a shoe holding hole and a cutout opening in another retainer plate, the view also showing a range in which the annular groove of a shoe can be held against an edge of the shoe holding hole.

When the cylinder block 10 rotates both clockwise and counterclockwise, the annular groove 21 of each shoe 20 engages the inner circumferential surface of the shoe holding hole 32 in the opposite regions ER, EL, as shown in FIG. 11. When the cylinder block 10 rotates only clockwise, they engage each other in the region ER only as shown in FIG. 12. In this case, a cutout opening 33' may be displaced or offset away from the region ER as shown in FIG. 12. The configuration shown in FIG. 12 allows the cutout opening 33' to be defined reliably away from the region ER even if the annular groove of the shoe has a relatively large outside diameter, resulting in an increase in the region ER.

Figure 13:
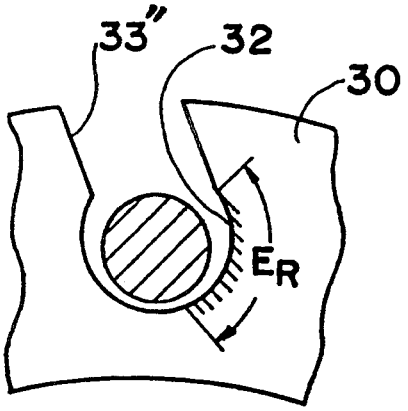
FIG. 13 is a fragmentary cross-sectional view of the shapes of a shoe holding hole and a cutout opening in still another retainer plate, the view also showing a range in which the annular groove of a shoe can be held against an edge of the shoe holding hole.
Figure 14:
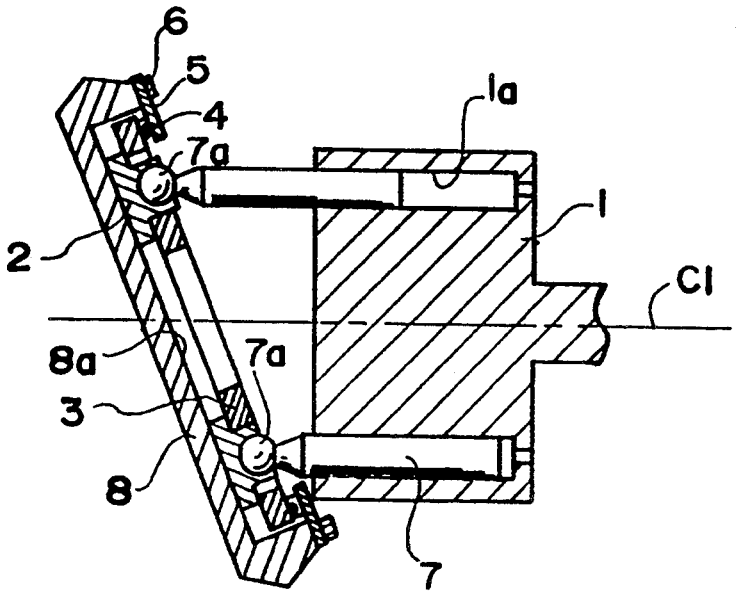
FIG. 14 PRIOR ART
FIG. 14 is a cross-sectional view of a conventional swash-plate, plunger-type hydraulic pump.
Figure 15:
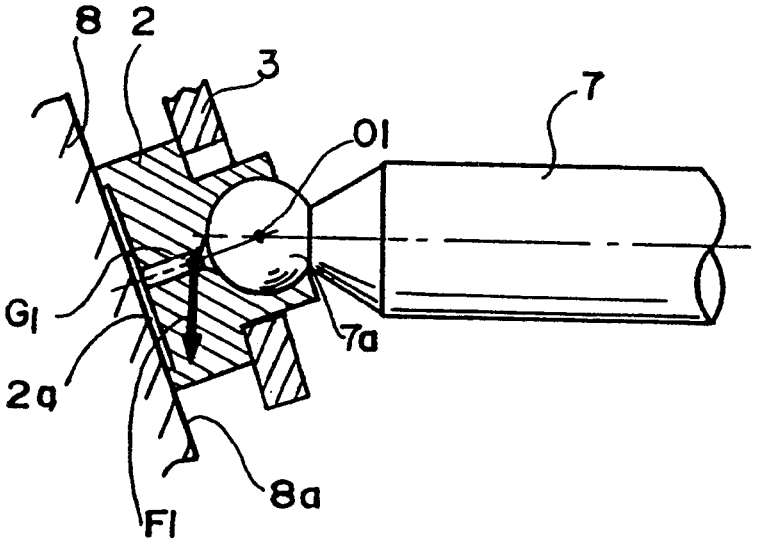
FIG. 15 PRIOR ART
FIG. 15 is a cross-sectional view of a plunger and a shoe that are coupled to each other in the conventional swash-plate, plunger-type hydraulic pump shown in FIG. 14.
Figure 16:
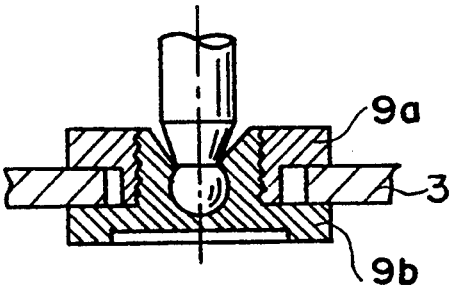
FIGS. 16(A) and 16(B) are fragmentary cross-sectional views showing different conventional structures in which a retainer plate and a shoe are coupled to each other.
Figure 16:
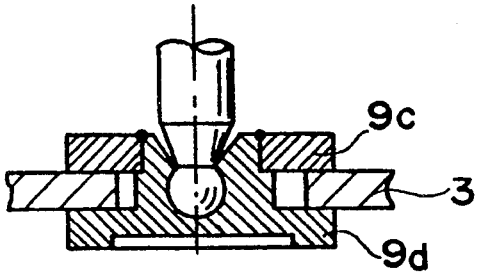
FIG. 16 (B) PRIOR ART

Alternatively, a cutout opening 38" may be inclined so that one edge thereof extends tangentially to the shoe holding hole 32, as shown in FIG. 13.

Although certain preferred embodiments of the present invention have been shown and described in detail, it should be understood that various changes and modifications may be made therein without departing from the scope of the appended claims.

What is claimed is:

1. A swash-plate, plunger-type hydraulic pressure apparatus comprising:

a cylinder block rotatable about an axis;

an annular array of plungers slidably held in said cylinder block in surrounding relationship to said axis and each said plunger having a spherical end;

a swash plate having a sliding surface confronting spherical ends of said plungers;

a plurality of shoes engaging said sliding surface and each said shoe having a spherical recess receiving said plunger spherical end for forming a ball joint and angularly movably coupling said shoes to said plungers; and a single retainer plate, with substantially flat and parallel sides, mounted on said swash plate and holding said shoes in slidable contact with said sliding surface;

said shoes each having a cylindrical body portion adjacent said sliding surface with an annular groove formed in an outer cylindrical peripheral surface of the cylindrical body portion separate from a portion forming the coupling of said shoe to a said plunger end thereof;

said shoes each having a center of gravity substantially coinciding with a center of said spherical recess;

said annular grooves each having a pair of substantially parallel and radially outwardly extending surfaces; and said retainer plate having a plurality of shoe holding holes defined therein and a like plurality of cutout openings extending from the shoe holding holes, said shoe holding holes communicating with one of outer and inner circumferential edges of said retainer plate through said cutout openings, each said cutout opening having a width slightly larger than the outside diameter of said annular groove, whereby said annular groove of each shoe be is inserted into the shoe holding holes, respectively, through said cutout openings and said shoes are held by said single retainer plate so as to be kept in contact with said sliding surface with said retainer plate sides slidably engaging portions of said pair of annular groove surfaces.

2. A swash plate, plunger-type hydraulic pressure apparatus according to claim 1, wherein said shoe holding holes have an inside diameter large enough to allow the shoes, with the annular grooves inserted in the respective shoe holding holes, to make an elliptical movement on said swash plate in response to rotation of said cylinder block, each of said shoes having portions of said cylindrical body portion on the opposite sides of the annular groove, said portions having an outside diameter larger than the inside diameter of one of said shoe holding holes.

3. A swash plate, plunger-type hydraulic pressure apparatus according to claim 1, wherein each of said cutout openings is connected to one of said shoe holding holes in a position other than a region where a bottom surface of the annular groove engages an inner circumferential surface of the shoe holding hole during an elliptical movement of the shoe on said swash plate in response to rotation of said cylinder block.

4. A swash plate, plunger-type hydraulic pressure apparatus according to claim 1, further including a plurality of keeper plates mounted on said retainer plate respectively at said shoe holding holes, each of said keeper plates having a second shoe holding hole and a second cutout opening, said keeper plate closing the cutout opening in said retainer plate.

5. A swash plate, plunger-type hydraulic pressure apparatus according to claim 3, wherein said shoe holding holes have an inside diameter large enough to allow the shoes, with the annular grooves inserted in the respective shoe holding holes, to make the elliptical movement on said swash plate in response to rotation of said cylinder block, each of said shoes having portions of said cylindrical body portion on opposite sides of the annular groove, said portions having an outside diameter larger than the inside diameter of one of said shoe holding holes.

* * * * *